US006540554B2

(12) United States Patent
McCarthy

(10) Patent No.: US 6,540,554 B2
(45) Date of Patent: Apr. 1, 2003

(54) REMOVABLY MOUNTABLE RECEPTACLE UNIT

(76) Inventor: David G. McCarthy, 59 Applewood Dr., Huntington, CT (US) 06484

( * ) Notice: Subject to any disclaimer, the term of this patent is extended or adjusted under 35 U.S.C. 154(b) by 0 days.

(21) Appl. No.: 09/794,739

(22) Filed: Feb. 27, 2001

(65) Prior Publication Data

US 2002/0119698 A1 Aug. 29, 2002

(51) Int. Cl.[7] ..... H01R 13/60
(52) U.S. Cl. ..... 439/574
(58) Field of Search ..... 439/214, 574, 439/650, 653

(56) References Cited

U.S. PATENT DOCUMENTS

| | | | | |
|---|---|---|---|---|
| 1,870,274 | A | | 8/1932 | Wulfert et al. |
| 2,271,463 | A | | 1/1942 | Reeves |
| 2,470,196 | A | | 5/1949 | Thrasher |
| 3,049,688 | A | | 8/1962 | Sinapoli |
| 3,297,886 | A | | 1/1967 | Danner |
| 3,535,508 | A | * | 10/1970 | Warshauser ..... 362/396 |
| 3,956,573 | A | | 5/1976 | Myers et al. |
| 4,500,150 | A | | 2/1985 | Leibensperger et al. |
| 4,875,878 | A | | 10/1989 | Meyer |
| 5,057,039 | A | | 10/1991 | Persing et al. |
| 5,124,506 | A | | 6/1992 | Briggs et al. |
| 5,199,888 | A | | 4/1993 | Condra et al. |
| 5,238,416 | A | | 8/1993 | Dickie |
| 5,318,259 | A | | 6/1994 | Fussler |
| 5,501,614 | A | | 3/1996 | Tsuchiya |
| 5,788,521 | A | | 8/1998 | Milan |
| D401,221 | S | | 11/1998 | Dwight et al. |
| 5,899,761 | A | | 5/1999 | Crane et al. |
| 5,964,618 | A | | 10/1999 | McCarthy |
| 6,004,157 | A | * | 12/1999 | Glass ..... 439/574 |
| 6,042,426 | A | | 3/2000 | Byrne |

* cited by examiner

*Primary Examiner*—Lynn D. Feild
*Assistant Examiner*—Thanh-Tam Le
(74) *Attorney, Agent, or Firm*—Mark P. Stone

(57) ABSTRACT

An electrical receptacle unit is formed from a housing having a top section, a bottom section, and a recessed portion separating the top and bottom sections. The top section includes receptacles for removably receiving electrical plugs and other communication lines and cords. The housing is connectable to sources of electrical line power and existing communication lines for activating the receptacles in the upper section of the housing. The recessed portion of the housing receives the edge of a supporting structure, as for example, a table top, for removably mounting the housing to the supporting structure.

11 Claims, 2 Drawing Sheets

REMOVABLY MOUNTABLE RECEPTACLE UNIT

BACKGROUND OF THE INVENTION

The present invention is directed to electrical and communication receptacle units, and in particular electrical receptacles and receptacles for communication lines adapted to be mounted proximate to a work area.

U.S. Pat. No. 5,964,618, entitled "Removable Desktop Electrical Receptacle Unit", was issued to the present Applicant on Oct. 12, 1999. The disclosure of this patent is incorporated by reference herein. U.S. Pat. No. 5,964,618 is directed to a removable electrical receptacle unit which includes a housing having a plurality of separate electrical receptacles. A plate-like mounting element extends downwardly from the bottom surface of the housing, and a slot is defined in the plate-like element. The plate-like element and the slot cooperate with separate mounting means including a separate clamp element 22 for removably mounting the housing to a work surface.

U.S. Pat. Nos. 1,870,274; 2,271,463; 2,470,196; 3,049,688; 3,297,886; 3,956,573; 4,500,150; 5,057,039; 5,124,506; 5,199,888; 5,238,416; 5,501,614; and 5,788,521 were each cited of record during the prosecution of the application resulting in U.S. Pat. No. 5,964,618. Each of these patents generally illustrates the background state of the art.

U.S. Pat. Nos. 4,875,878; 5,318,259; 5,899,761; 6,042,426; and Des. Pat. No. 401,221 also generally disclose removably mountable or portable electrical receptacle units. These patents, like the previously identified patents, generally illustrate the background state of the art.

It is a primary object of the present invention to provide a removably mountable receptacle unit constituting an improvement over the device disclosed by U.S. Pat. No. 5,964,618. In accordance with this objective, the improvement of the present invention provides a housing having upper and lower sections integrally connected to each other and separated by a recessed portion for mounting the housing, as a whole, to a supporting structure, such as an edge of a table top or desk.

Other objects and advantages of the present invention will become apparent from the following discussion herein.

SUMMARY OF THE INVENTION

The present invention provides a receptacle unit including one or more receptacles for removably receiving plugs from electrical wires or communication lines. The receptacle unit is formed from a housing having an upper section and a lower section, the upper and lower sections being integrally connected to each other but separated by a generally centrally disposed recess defined in the housing. The individual electrical and communication receptacles are provided in the upper section of the housing. The lower section of the housing includes means for coupling the housing to sources of electrical line power and existing communication lines for activating or energizing the individual receptacles in the upper section of the housing.

The recessed portion of the housing separating the upper and lower housing sections is provided for mounting the housing, as a whole, to a supporting structure such as the edge of a table top or desk. The housing is moved relative to the table top so as to receive a portion of the edge of the table top in the recessed portion of the housing for removably mounting the housing to the table top. Additional means can be provided to firmly secure the housing to the edge of the table top when the housing is mounted thereto. Accordingly, the housing is readily -mounted to a table top and readily removably therefrom to provide temporary means for connecting electrical and communications equipment supported on the table top to the receptacles in the upper section of the housing. In this manner, equipment such as telephones, fax machines, computers, and recording devices are supported on the top of, for example, a conference table, to enable the equipment to be used during a meeting conducted around the conference table, and the housing can be readily removed from the conference table after the meeting has concluded.

In a further aspect of the present invention, a system of separate housings, each of which includes the same or different numbers of receptacles, are combined to meet varying power and communications needs. For example, a first housing can include a single electrical receptacle, a single communications line receptacle, or both a single electrical receptacle and a single communications line receptacle. A second housing can include two separate electrical receptacles, two separate communications receptacles, or both electrical receptacles and communications line receptacles. Other housings can include different numbers of electrical and/or communications line receptacles. In this manner, the number of separate housings removably mounted to a supporting surface is selectively adjustable to meet varying needs for different numbers of electrical and communications line receptacles available to meet differing needs for different occasions.

DESCRIPTION OF THE BEST MODES FOR CARRYING OUT THE INVENTION

Figure 1:
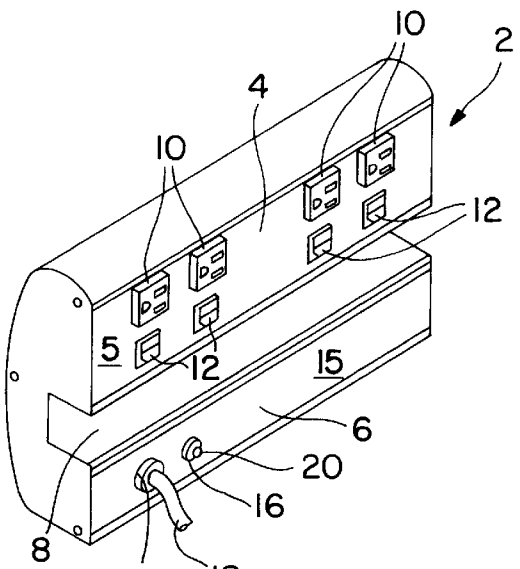
FIG. 1 illustrates a perspective view of one example of a removable receptacle unit in accordance with the present invention.

FIG. 1 of the drawing illustrates an exemplary embodiment of a receptacle unit in accordance with the present invention. The receptacle unit is formed from a housing generally designated by reference numeral 2. The housing includes an upper section designated by reference numeral 4 which is integrally connected to a lower section designated by reference numeral 6. The housing also defines a generally centrally disposed recessed section 8 for separating the front portions of the upper and lower housing sections 4 and 6.

Figure 4:
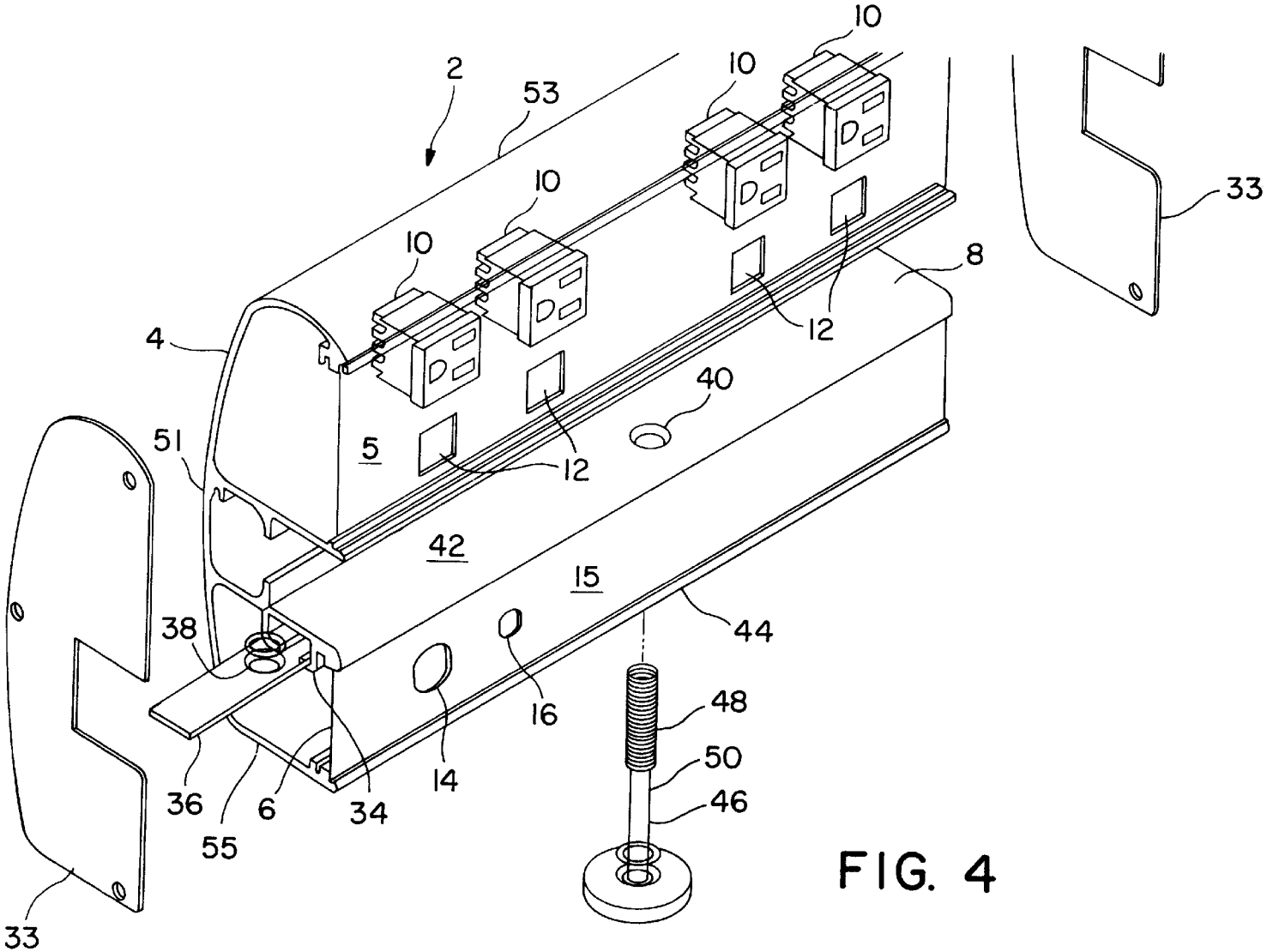
FIG. 4 is an exploded view, partly in section, of the receptacle unit illustrated by FIG. 1.

The housing 2, as best shown by FIG. 4, has a common rear wall 51 integrally connected to both the upper housing section 4 and the lower housing section 6. A top wall 53 and a bottom wall 55 integrally merge with the rear wall 51.

The upper housing section 4 includes a plurality of electrical receptacles designated by reference numeral 10, and a plurality of communication line receptacles designated by reference numeral 12. These receptacles are provided for removably receiving the plugs of electrical appliances and communications equipment (e.g., telephones, fax machines), respectively. Although the drawing illustrates four electrical receptacles 10 and four communications receptacles 12, this has been done for illustrative purposes only. The housing 2 can include different numbers of receptacles. For example, it is within the scope of the invention for the housing to include only a single electrical receptacle, only a single communications line receptacle, or only a single electrical receptacle and a single communications line receptacle. Likewise, the maximum number of electrical receptacles and/or communications receptacles provided on the upper housing section 4 is limited only by the desired length of the housing. The receptacles 10 and 12 are provided on the front surface 5 of the upper housing section 4 to provide easy access to the receptacles when the housing is mounted to a supporting structure, as will be discussed in greater detail below.

The front surface 15 of the lower housing section 6 defines two openings designated by reference numerals 14 and 16 (See also FIG. 4). The opening 14 is provided to receive an electrical cord designated by reference numeral 18 for coupling the housing 2 to a source of electrical line power for actuating the electrical receptacles 10 in the upper housing section 4. Similarly, the opening 16 is provided for a cord 20 for coupling the housing 2 to existing communication (e.g. telephone) lines for activating the communications receptacles 12 in the upper housing section 4.

Figure 2:
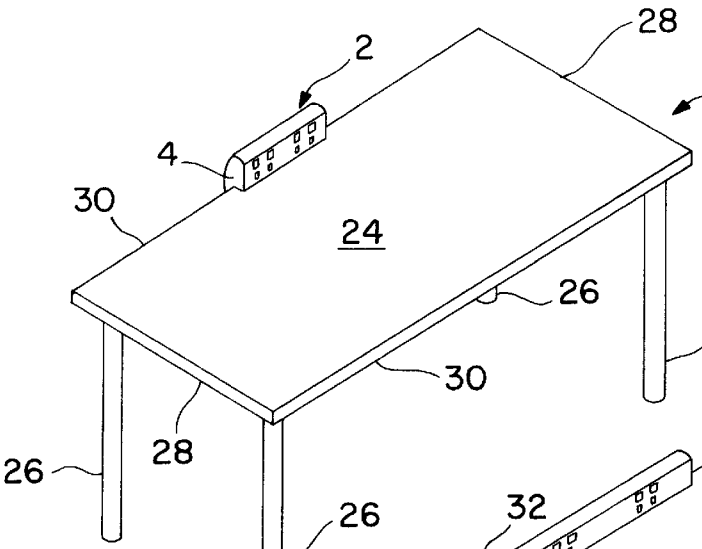
FIG. 2 illustrates the receptacle unit shown by FIG. 1 mounted to the edge of a table top.

Referring now to FIG. 2, a table 22 includes a table top 24 and four supporting legs 26. The table top 24 illustrated by FIG. 2 is rectangular in configuration, and the periphery thereof is defined by two opposed end edges 28 and two opposed side edges 30. Although the table 24 illustrated by FIG. 2 is rectangular in configuration, this is for illustrative purposes only, and the table top can be of any other geometrical configuration.

Still referring to FIG. 2, a receptacle unit 2, as illustrated by FIG. 1 of the drawing, is removably mounted to one side edge 30 of the table top 24. When the receptacle unit 2 is mounted to the table top 24, the side edge 30 is received within the recessed portion 8 of the housing 2, as shown in FIG. 1. When the housing 2 is mounted to the table top 24 in the orientation illustrated by FIG. 2, the top housing section 4 extends above the top surface of the table top 24, while the bottom housing section 6 (not shown in FIG. 2) extends below the bottom surface of the table top 24. In this manner, the receptacles 10 and 12 are readily accessible to individuals at the table 22 for connecting electrical appliances and communications equipment, while the lower housing section 6, the cable 18, and the line 20 are concealed from view beneath the table top. Although FIG. 2 illustrates a table 22 as the supporting structure for the housing 2, other suitable supporting structures (such as desks) having peripheral edges receivable within the recessed portion 8 of the housing 2 can be used to support the housing 2.

Figure 3:
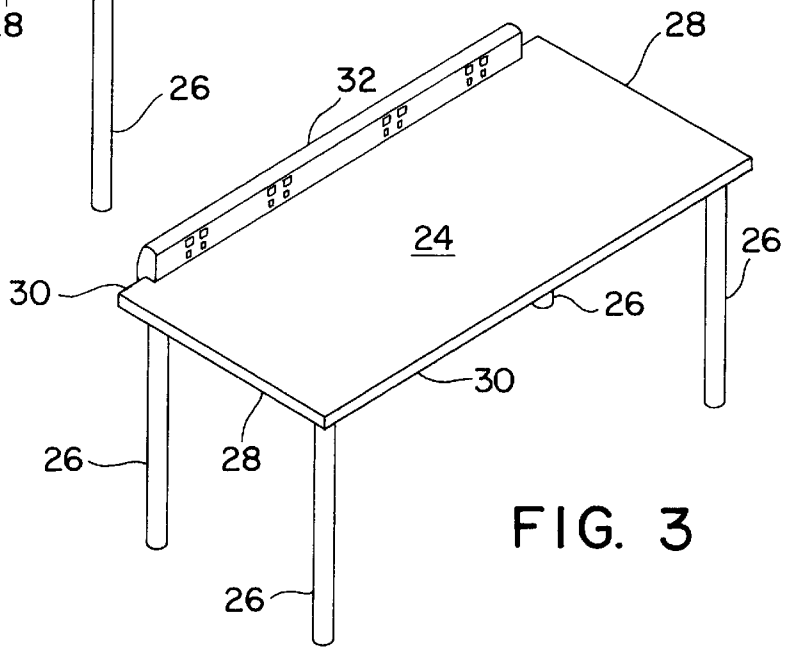
FIG. 3 illustrates a receptacle unit larger than that illustrated by FIG. 1 mounted to the edge of a table top.

Turning now to FIG. 3, this drawing illustrates a housing 32 removably mountable to an edge 30 of the table top 24 shown in FIG. 2. The housing 32 extends substantially along the entire edge 30 of the table top 24. The housing 32 also includes twice as many electrical receptacles 10 (See FIG. 1) and twice as many communication receptacles 12 (See FIG. 1) than that provided by the housing 2. FIGS. 2 and 3 illustrate that, in accordance with the present invention, different size housings having different numbers of electrical receptacles and communication receptacles, are removably mountable to the supporting structure. In this manner, the number of electrical receptacles 10 and communication receptacles 12 can be selectively adjusted to meet different and varying power and communication needs of equipment supported on, or proximate to, the table top 24. Additionally, although not shown in the drawing, a plurality of separate housings (such as the housing illustrated by reference numeral 2) can be removably mounted in close proximity to each other on one or more edges of the table top 24. Similarly, separate receptacle units having different numbers of electrical receptacles or communications receptacle can be separately mounted to one or more different edges of the table top 24.

FIG. 4 illustrates the receptacle unit 2 shown by FIG. 1 in greater detail. The same reference numerals used in FIG. 1 are used to designate the same elements in FIG. 4. In FIG. 4, two end plates designated by reference numeral 33 are shown removed from the opposed ends of the housing 2. When the housing is in its assembled position as illustrated by FIG. 1, the end plates 33 are removably mounted to opposed ends of the housing 2 by conventional mounting means such as screws.

Still referring to FIG. 4, a bracket 34 extends downwardly from the top surface of lower housing section 6. The bracket 34 defines a channel for receiving a slat-shaped plate 36 having an opening 38 defined therein. When the housing 2 is in its operational position, the plate 36 is oriented within the bracket 34 such that opening 38 in the plate 36 is in axial alignment and registration with an opening 40 defined on a top surface 42 of the lower housing section 6. A similar opening (not shown in the drawing) in axial alignment and registration with opening 40, is defined on a lower surface 44 of the lower housing section 6.

FIG. 4 also illustrates a clamping screw generally designated by reference numeral 46. The clamping screw is provided to more firmly retain the housing 2 on a supporting surface to which it is mounted. After an edge of a supporting surface (e.g., edge 30 of table top 24 shown in FIG. 2) is received in the recessed portion 8 of the housing 2, the clamping screw 46 is inserted into the opening (not shown) in the lower surface 44 of the lower housing section 6, through the aligned opening 38 in the plate 36, and through the aligned opening 40 in the top surface of the lower housing section 6. The head of the clamping screw 46 which extends through the opening 40 and above the top surface 42 of the lower housing section 6, engages the lower surface of the table top 24 as illustrated in FIGS. 2 and 3 to more firmly retain the housing 2 mounted to the table top 24 as illustrated in FIGS. 2 and 3. A spring 48 is mounted to the top of the shaft 50 of the clamping screw 46 to exert a resilient force on the clamping screw as it is threaded through opening 40 to engage the lower surface of the table top 24 when the housing 2 is mounted to the table top as illustrated in FIGS. 2 and 3.

When the housing is to be removed from the table top 24, the steps of the procedure described above are reversed. The clamping screw 46 is removed from the opening 40 in the top surface 42 of the lower housing section 6 so that the head of the screw disengages from the bottom surface of the table top 24. Thereafter, the housing 2 is displaced relative to the edge 30 of the table top 24 so that the housing can be removed from the table top by sliding the housing such that the edge 30 of the table top 24 is no longer received in the recessed portion 8 of the housing. Electrical cable 18 and communication line 20 (See FIG. 1) are unplugged from their respective sources of electrical power and existing communication lines, and the housing 2 can be placed in storage for future use, or can be removably mounted to a different supporting structure.

The receptacle unit in accordance with the present invention provides several different advantages over the known devices. It is a substantially integral device which is readily mountable to, and removable from, a supporting surface as a single unit. The system in accordance with the present invention provides the capability of selectively varying the electrical energy and communication requirements to meet immediate varying needs encountered in different situations.

Although the present invention has been illustrated with receptacle units having specific numbers of electrical receptacles and communication ports, this has been done for illustrative purposes only and does not limit the invention to any specific number of receptacles or ports. Additionally, although the invention has been discussed with respect to a supporting structure provided by a rectangular table top, this too has been done for illustrative purposes, and other types of supporting structures having different geometrical configurations can be employed in connection with the present invention.

Other modifications of the receptacle unit and systems described herein within the scope of the present invention will become apparent to those skilled in the art. Accordingly, the discussion of the preferred embodiments of the invention is intended to be illustrative only, and not restrictive of the scope of the invention, that scope being defined by the following claims and all equivalents thereto.

What is claimed is:

1. A receptacle unit adapted to be removably mounted to a supporting structure, said receptacle unit comprising:

a housing having a first housing section and a second housing section, said first and second housing sections being integrally connected to each other;

said housing defining a recessed portion between said first and second housing sections;

retaining means operatively associated with said housing for retaining said housing mounted to said supporting structure; and said retaining means comprising at least one opening defined in said second housing section, and a retaining element adapted to be received in said opening such that a forward end of said retaining element extends above an upper surface of said second housing section and into said recessed portion defined between said first and second housing sections when said housing is removably mounted to said supporting structure;

wherein said second housing section is a lower section, said lower section including a bracket and a slat received within said bracket, said slat defining at least one opening therein in alignment with said at least one opening defined in said second housing section.

2. The receptacle unit as claimed in claim 1, wherein said retaining element is a screw defining a shaft portion and a spring mounted to said shaft portion of said screw.

3. The receptacle unit as claimed in claim 1 further including at least one electrical receptacle in said first housing section.

4. The receptacle unit as claimed in claim 1 further including at least one receptacle for receiving a communications line in said first housing section.

5. The receptacle unit as claimed in claim 1 wherein said first housing section is an upper housing section.

6. The receptacle unit as claimed in claim 1 further including means in said second housing section for connecting said housing to a source of electrical power.

7. The receptacle unit as claimed in claim 1 further including means in said second housing section for connecting said housing to a communications network.

8. The receptacle unit as claimed in claim 1 further including first means in said second housing section for connecting said housing to a source of electrical power, and second means in said second housing section for connecting said housing to a communications network.

9. The receptacle unit as claimed in claim 1 wherein said recessed portion defined between said first and second housing sections is longitudinally oriented relative to said housing.

10. The receptacle unit as claimed in claim 9 wherein said recessed portion defined between said first and second housing sections is substantially centrally disposed between said first and second housing sections.

11. The receptacle unit as claimed in claim 10 wherein said recessed portion defined between said first and second housing sections is generally rectangular in cross section.

* * * * *